US008168902B2

(12) United States Patent
Tang et al.

(10) Patent No.: US 8,168,902 B2
(45) Date of Patent: May 1, 2012

(54) ELECTRICAL DEVICE WITH A WATERPROOF KEYPAD

(75) Inventors: Wen-Lang Tang, Taipei Hsien (TW); Wen-Hsin Wang, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 333 days.

(21) Appl. No.: 12/350,569

(22) Filed: Jan. 8, 2009

(65) Prior Publication Data

US 2010/0059347 A1 Mar. 11, 2010

(30) Foreign Application Priority Data

Sep. 8, 2008 (TW) ..... 97134380 A

(51) Int. Cl.
*H01H 9/04* (2006.01)

(52) U.S. Cl. ..... 200/302.1

(58) Field of Classification Search ..... 200/302.1, 200/302.2, 5 A

See application file for complete search history.

(56) References Cited

U.S. PATENT DOCUMENTS

| | | | | |
|---|---|---|---|---|
| 4,022,993 | A * | 5/1977 | Shattuck | 200/314 |
| 5,340,955 | A * | 8/1994 | Calvillo et al. | 200/302.2 |
| 6,172,620 | B1 * | 1/2001 | Brick et al. | 341/22 |
| 2007/0125629 | A1 * | 6/2007 | Senzui | 200/5 A |

FOREIGN PATENT DOCUMENTS

| | | |
|---|---|---|
| JP | 2001-148726 A | 5/2001 |
| TW | 476429 | 2/2002 |
| TW | M311078 U | 5/2007 |

OTHER PUBLICATIONS

First Office Action dated Feb. 25, 2011 issued by Chinese Patent Office for corresponding Chinese Patent Application No. 200810149412.6 with abridged English translation of office action.

* cited by examiner

*Primary Examiner* — Vanessa Girardi

(74) *Attorney, Agent, or Firm* — Frommer Lawrence & Haug LLP; Ronald R Santucci

(57) ABSTRACT

An electrical device includes a housing, a circuit unit disposed in the housing, a waterproof keypad disposed in the housing at a position above the circuit unit, and a press member. The waterproof keypad includes a rigid layer, a resilient pad body, a waterproofing ring, and a plurality of keys. The press member is connected to the housing and presses against the rigid layer. The waterproofing ring is connected to a bottom face of the resilient pad body, abuts against the housing, and surrounds the circuit unit. A portion of a top face of the resilient pad body is connected immovably to a bottom face of the rigid layer. Another portion of the top face of the resilient pad body is exposed from the rigid layer. The keys are connected to the exposed portion of the top face of the resilient pad body and are exposed from the rigid layer.

11 Claims, 1 Drawing Sheet

ELECTRICAL DEVICE WITH A WATERPROOF KEYPAD

CROSS-REFERENCE TO RELATED APPLICATION

This application claims priority of Taiwanese Application No. 097134380, filed on Sep. 8, 2008, the disclosure of which is incorporated herein by reference.

BACKGROUND OF THE INVENTION

1. Field of the Invention

The present invention relates to an electrical device with a waterproof keypad, more particularly to an electrical device with a waterproof keypad using a waterproofing pad body for achieving a waterproof effect.

2. Description of the Related Art

Referring to FIG. 1, a conventional electrical device 1 with a waterproof keypad includes a housing 11, a circuit unit 12 disposed in the housing 11, a waterproof keypad 13 disposed in the housing 11 at a position above the circuit unit 12, and a press member 14 connected to the waterproof keypad 13. The waterproof keypad 13 and the press member 14 are secured with the use of screws. The waterproof keypad 13 includes a rubber pad 131 and a plurality of keys 132 disposed on the rubber pad 131. A waterproofing ring 133 projects from a bottom face of the rubber pad 131. When one of the keys 132 is pressed, a part of the rubber pad 131 deforms and actuates a switch disposed on the circuit unit 12.

When the waterproof keypad 13 is disposed in the housing 11, the waterproofing ring 133 surrounds the perimeter of the circuit unit 12 to achieve a waterproof effect of the waterproof keypad 13. Moreover, a pressure exerted upon the rubber pad 131 by the press member 14 forces the waterproofing ring 13 to abut against the housing 11 so as to avoid water or other liquids from permeating through a gap between the waterproofing ring 133 and the housing 11, thereby avoiding short-circuiting of the circuit unit 12.

However, a disadvantage of conventional structure resides in that, because the rubber pad 131 is made of a resilient material, the rubber pad 131 easily deforms curvedly when subjected to a pressure or other forces. For example, torsion due to a screw causes a part of the rubber pad 131 to twist and deform during screwing. Once the rubber pad 131 deforms, it is not ensured that the press member 14 can evenly abut against the rubber pad 131. As a result, because it is possible that the pressure exerted upon a part of the rubber pad 131 is not sufficient, a gap is likely to form between the waterproofing ring 131 and the housing 11, and water or other liquids can permeate through the gap and cause damage to the circuit unit 12. It has been verified through experiments that the waterproof effect of the conventional structure can meet about the IPX4 standard in the IEC 60529.

SUMMARY OF THE INVENTION

Therefore, an object of the present invention is to provide an electrical device with a waterproof keypad whose waterproof effect is enhanced.

Another object of the present invention is to provide an electrical device with a waterproof keypad in which the deformation of a resilient pad body of the waterproof keypad does not affect the waterproof effect.

Accordingly, an electrical device with a waterproof keypad of the present invention comprises: a housing; a circuit unit disposed in the housing; a waterproof keypad disposed in the housing at a position above the circuit unit; and a press member. The waterproof keypad includes a rigid layer, a resilient pad body, a waterproofing ring, and a plurality of keys. The resilient pad body has a top face and a bottom face. A portion of the top face of the resilient pad body is connected immovably to a bottom face of the rigid layer. Another portion of the top face of the resilient pad body is exposed from the rigid layer. The waterproofing ring is connected to the bottom face of the resilient pad body, abuts against the housing, and surrounds the circuit unit. The plurality of keys are connected to the exposed portion of the top face of the resilient pad body and are exposed from the rigid layer. The press member is connected to the housing and presses against the rigid layer.

In the present invention, through the rigid layer disposed on the resilient pad body and connected tightly to the resilient pad body, undesired deformation of the resilient pad body due to an applied force can be avoided. Moreover, because the press member presses against the rigid layer, the pressure provided by the press member can be exerted more evenly upon the resilient pad body via the rigid layer, such that the waterproofing ring is able to press against the housing tightly and stably for enhancing the waterproof effect of the waterproof keypad.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
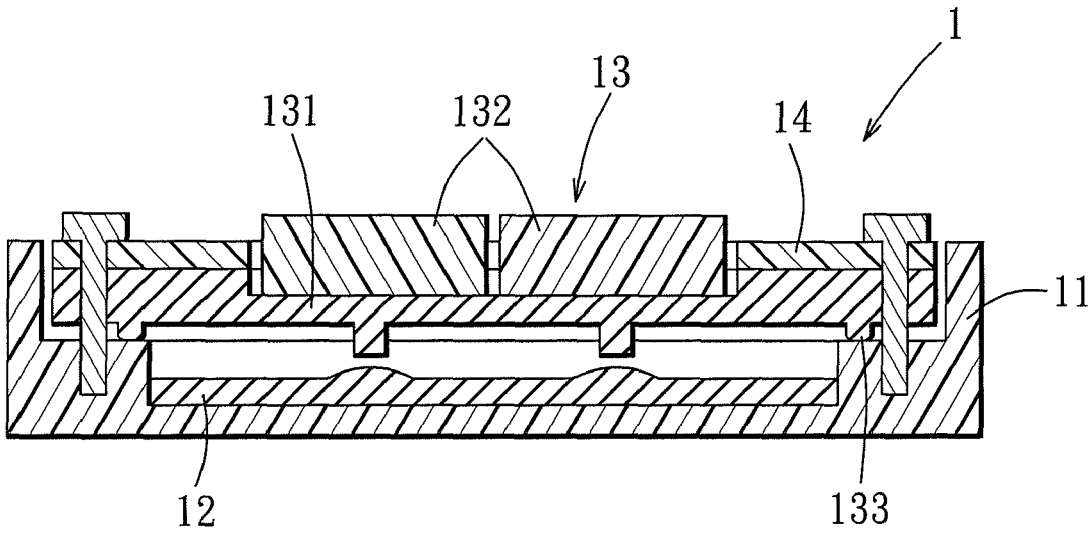
FIG. 1 PRIOR ART
FIG. 1 is a sectional view of a conventional electrical device with a waterproof keypad.
Figure 2:
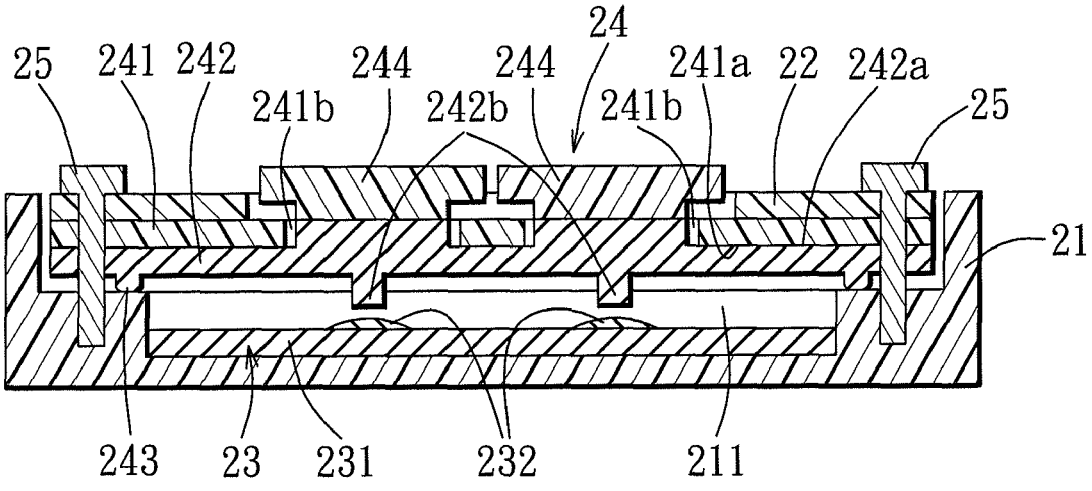
FIG. 2 is a sectional view of a preferred embodiment of an electrical device with a waterproof keypad according to the present invention.

Referring to FIG. 2, the preferred embodiment of an electrical device with a waterproof keypad according to the present invention includes a housing 21, a press member 22, a circuit unit 23, a waterproof keypad 24, and a plurality of fasteners 25.

The housing 21 is hollow to form an accommodating space 211 with an open top. The circuit unit 23 is disposed in the accommodating space 211 of the housing 21. The waterproof keypad 24 is disposed in the housing 21 at a position above the circuit unit 23. The press member 22 is fastened to the housing 21 via the fasteners 25, and presses against the waterproof keypad 24. The fasteners 25 are screws in this embodiment.

The circuit unit 23 includes a circuit board 231, and a plurality of switches 232 disposed on the circuit board 231.

The waterproof keypad 24 includes a rigid layer 241, a resilient pad body 242, a waterproofing ring 243, and a plurality of keys 244. A first portion of a top face (242*a*) of the resilient pad body 242 is connected immovably to a bottom face (241*a*) of the rigid layer 241. The waterproofing ring 243 projects from a bottom face of the resilient pad body 242. Moreover, a plurality of actuator portions (242*b*) also project from the bottom face of the resilient pad body 242. In this embodiment, the rigid layer 241 is made of a polycarbonate resin, and the resilient pad body 242 is preferably made of a thermoplastic elastomer or thermoplastic urethane. The rigid layer 241 and the resilient pad body 242 are interconnected via double-injection molding techniques for connecting tightly to each other so that the first portion of the top face (242*a*) of the resilient pad body 242 is connected immovably to the bottom face (241*a*) of the rigid layer 241. Moreover, the rigid layer 241 has a plurality of holes (241*b*) formed during molding of the rigid layer 241. The holes (241*b*) serve to expose a second portion of the resilient pad body 242 from the rigid layer 241 so that the keys 244 can be connected to the resilient pad body 242 and be exposed from the rigid layer 241.

In another manner for fabricating, the rigid layer 241 is formed first, followed by placing the rigid layer 241 into an injection mold or a hot-pressing mold. The resilient pad body 242 is formed via insert molding, and is connected to the rigid layer 241.

It is noted that, the so-called rigid layer of the present invention is made of a material with sufficient rigidity such that the rigid layer does not flexibly deform when a force applied thereto. However, the condition that the rigid material does not flexibly deform does not include a deformation due to gravity in view of an excessively long length or shape.

Each of the fasteners 25 extends through the press member 22, the rigid layer 241 and the resilient pad body 242, and engages an inner wall of the housing 21 for making the press member 22 press against the rigid layer 241. When the press member 22 and the waterproof keypad 24 are assembled and connected to the housing 21, the actuator portions (242*b*) projecting from the bottom face of the resilient pad body 242 are at positions corresponding to the switches 232 disposed on the circuit board 231. When one of the keys 244 is pressed, a part of the resilient pad body 242 flexibly deforms, causing one of the actuator portions (242*b*) of the resilient pad body 242 to actuate a corresponding one of the switches 232. On the other hand, the waterproofing ring 243 of the waterproof keypad 24 abuts against the inner wall of the housing 21, and surrounds the circuit unit 23.

It is noted that undesired deformation of the resilient pad body 242 does not easily occur (such as deformation attributed to torsion due to the fasteners 25 during fastening), because the resilient pad body 242 is connected tightly to the rigid layer 241 and is supported by the rigid layer 241. Moreover, because the press member 22 presses against the rigid layer 241, the pressure provided by the press member 22 can be exerted more evenly upon the resilient pad body 242 through the rigid layer 241 for ensuring that the waterproofing ring 243 projecting from the bottom face of the resilient pad body 242 is able to press tightly against the inner wall of the housing 21, thereby effectively avoiding liquids from permeating between the waterproofing ring 243 and the inner wall of the housing 21.

In addition, the resilient pad body 242 of this embodiment is made of a material with relatively high tensile strength, such as thermoplastic elastomers or thermoplastic polyurethane, for preventing the resilient pad body 242 from being torn apart due to pulling action of the keys 244.

In sum, undesired deformation of the resilient pad body 242 due to an applied force can be avoided in this invention by disposing the rigid layer 241 on the resilient pad body 242 and connecting the resilient pad body 242 and the rigid layer tightly to each other. Moreover, because the press member 22 presses against the rigid layer 241, the pressure provided by the press member 22 can be exerted more evenly upon the resilient pad body 242 through the rigid layer 241. Further, the waterproofing ring 243 tightly and stably abuts against the inner wall of the housing 21 for enhancing the waterproof effect of the waterproof keypad 24. It has been verified through experiments that the waterproof effect of the present invention can meet the IPX7 standard in the IEC 60529, i.e., ingress of water does not occur when the electrical device with the waterproof keypad 24 is immersed in the water under a depth of 1 meter and a duration of 30 minutes.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electrical device with a waterproof keypad, comprising:

a housing;

a circuit unit disposed in said housing;

a waterproof keypad disposed in said housing at a position above said circuit unit, said waterproof keypad including a rigid layer that has a top face and a bottom face, a resilient pad body that has a top face and a bottom face, a portion of said top face of said resilient pad body being connected immovably to said bottom face of said rigid layer, another portion of said top face of said resilient pad body being exposed from said rigid layer, a waterproofing ring that is connected to said bottom face of said resilient pad body, that abuts against said housing, and that surrounds said circuit unit, and a plurality of keys that are connected to said another portion of said top face of said resilient pad body and that are exposed from said rigid layer; and a press member fastened to the housing and in direct contact with and pressing against said top face of said rigid layer.

2. The electrical device with a waterproof keypad as claimed in claim 1, wherein said rigid layer is formed with a plurality of holes to expose said another portion of said top face of said resilient pad body and to permit connection between said keys and said resilient pad body.

3. The electrical device with a waterproof keypad as claimed in claim 1, further comprising a plurality of fasteners for fastening said waterproof keypad and said press member to said housing.

4. The electrical device with a waterproof keypad as claimed in claim 3, wherein said waterproofing ring is opposite to said portion of said top face of said resilient pad body connected immovably to said bottom face of said rigid layer, and is disposed between said fasteners and said circuit unit; and said fasteners extend through said press member, said rigid layer and said resilient pad body, and engage said housing for fastening said waterproof keypad and said press member to said housing to make said waterproofing ring press tightly against said housing.

5. The electrical device with a waterproof keypad as claimed in claim 3, wherein each of said fasteners is a screw that extends through said press member, said rigid layer and said resilient pad body and that engages said housing.

6. The electrical device with a waterproof keypad as claimed in claim 5, wherein said rigid layer and said resilient pad body are interconnected via double-injection molding techniques.

7. The electrical device with a waterproof keypad as claimed in claim 6, wherein said rigid layer is made of a polycarbonate resin.

8. The electrical device with a waterproof keypad as claimed in claim 6, wherein said resilient pad body is made of a material selected from thermoplastic elastomers and thermoplastic urethane.

9. The electrical device with a waterproof keypad as claimed in claim 5, wherein said resilient pad body is connected to said rigid layer via insert molding techniques.

10. The electrical device with a waterproof keypad as claimed in claim 9, wherein said resilient pad body is made of a material selected from thermoplastic elastomers and thermoplastic urethane.

11. The electrical device with a waterproof keypad as claimed in claim 9, wherein said rigid layer is made of a polycarbonate resin.

* * * * *